United States Patent [19]

Zebelean

[11] 4,432,549

[45] Feb. 21, 1984

[54] METAL GOLF DRIVER

[75] Inventor: John Zebelean, Oxnard, Calif.

[73] Assignee: Pro-Pattern, Inc., Ventura, Calif.

[21] Appl. No.: 6,577

[22] Filed: Jan. 26, 1979

Related U.S. Application Data

[63] Continuation-in-part of Ser. No. 872,092, Jan. 25, 1978, Pat. No. 4,214,754.

[51] Int. Cl.[3] ..... A63B 53/04

[52] U.S. Cl. ..... 273/167 H; 273/172

[58] Field of Search ..... 273/77 R, 78, 79, 163 R, 273/164, 167–175, 167 H

[56] References Cited

U.S. PATENT DOCUMENTS

| | | | |
|---|---|---|---|
| 1,167,106 | 1/1916 | Palmer | 273/171 |
| 1,497,578 | 6/1924 | Mothersele | 273/172 |
| 1,502,328 | 7/1924 | Beat | 273/172 |
| 1,526,438 | 2/1925 | Scott | 273/169 X |
| 1,568,888 | 1/1926 | Dunn | 273/167 H |
| 1,582,836 | 4/1926 | Link | 273/167 H |
| 1,720,867 | 7/1929 | Webster et al. | 273/169 |
| 1,917,774 | 7/1933 | Ogg et al. | 273/169 X |
| 2,447,967 | 8/1948 | Stone | 273/169 X |
| 3,081,087 | 3/1963 | Redd | 273/167 H X |
| 3,212,783 | 10/1965 | Bradley et al. | 273/167 F X |
| 3,941,390 | 3/1976 | Hussey | 273/169 |
| 3,976,299 | 8/1976 | Lawrence et al. | 273/167 F X |
| 4,021,047 | 5/1977 | Mader | 273/167 H |
| 4,063,737 | 12/1977 | Tom et al. | 273/174 |
| 4,139,196 | 2/1979 | Riley | 273/167 H X |
| 4,214,754 | 7/1980 | Zebelean | 273/167 F |

FOREIGN PATENT DOCUMENTS

| | | | |
|---|---|---|---|
| 153475 | 10/1953 | Australia | 273/167 H |
| 211781 | 12/1957 | Australia | 273/167 H |
| 595117 | 1/1978 | Switzerland | 273/167 H |
| 398643 | 9/1933 | United Kingdom | 273/167 H |
| 679292 | 9/1952 | United Kingdom | 273/167 H |
| 1476889 | 6/1977 | United Kingdom | 273/167 H |

*Primary Examiner*—George J. Marlo

*Attorney, Agent, or Firm*—Harris, Kern, Wallen & Tinsley

[57] ABSTRACT

An all metal hollow golf driver is formed by casting a first main part from metal, e.g., stainless steel, in the shape of practically a complete golf driver, except for an opening on one side of the driver body, e.g., the sole side. A second cast part fits within the opening and is weldable thereto to form a complete integral hollow metal golf driver. The weight (mass) of the driver is distributed in order to reduce its torque and/or deflection. The mass is distributed so that it increases from the top side toward the sole side and from the heel end toward the toe.

14 Claims, 15 Drawing Figures

FIG. 1
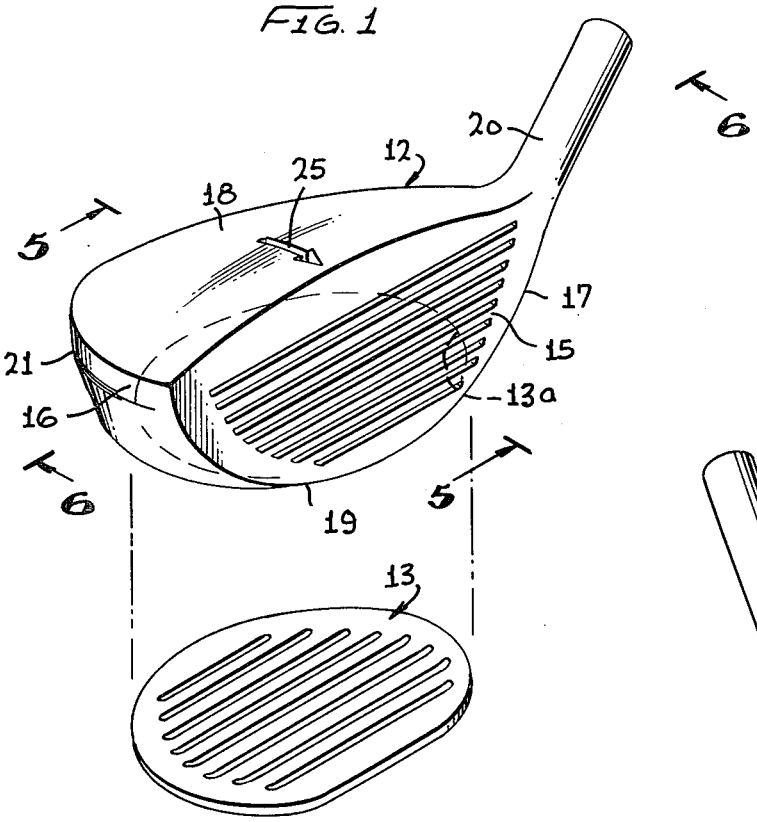
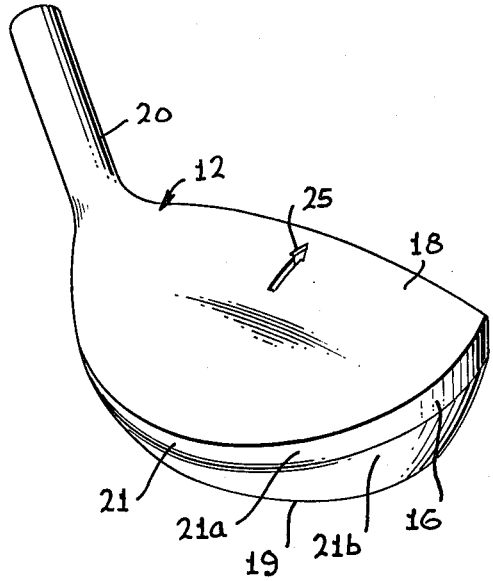
FIG. 2
FIG. 3
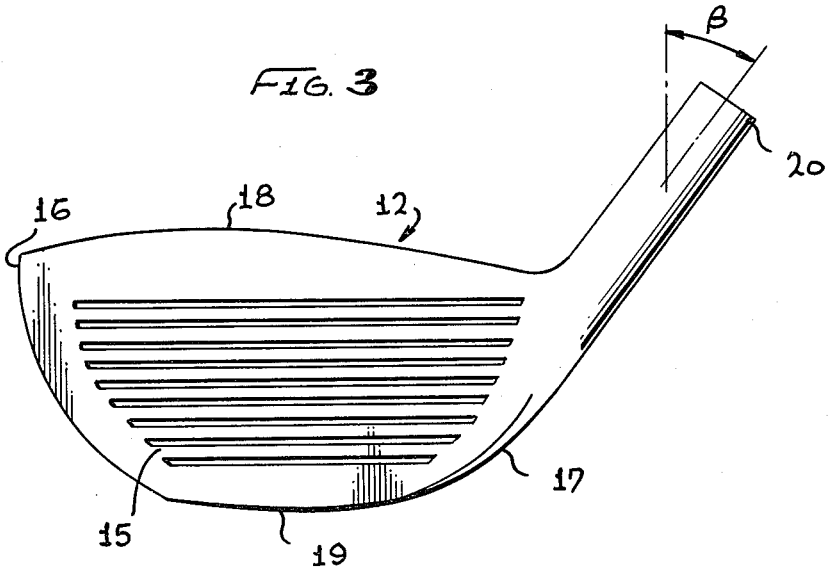

FIG. 8
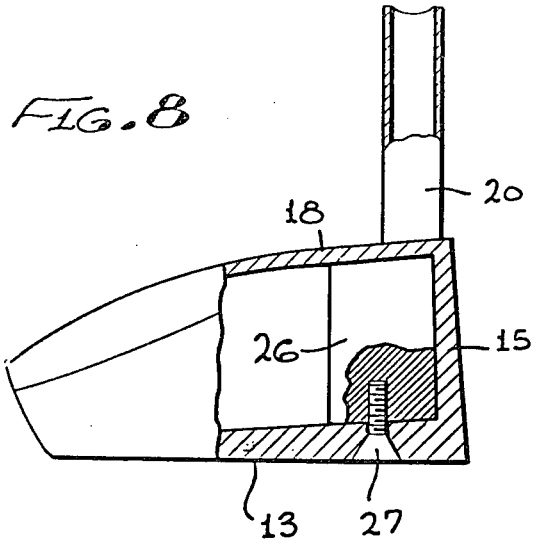
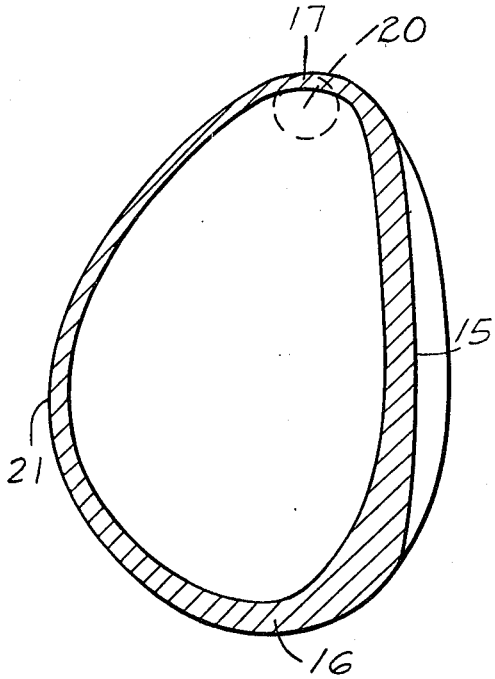
FIG. 15
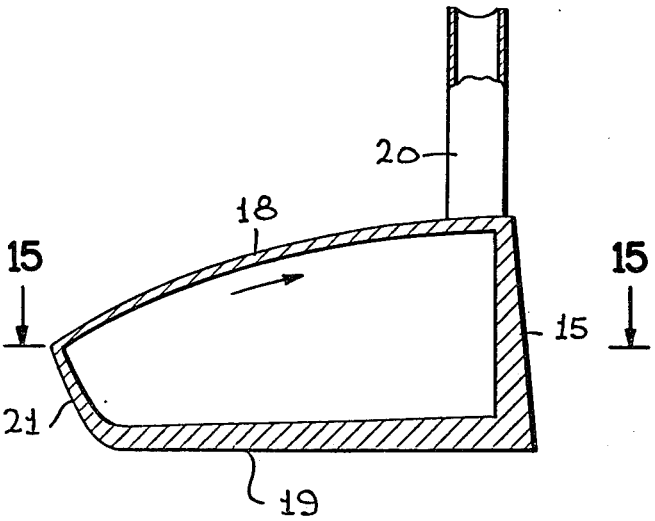
FIG. 12
FIG. 13
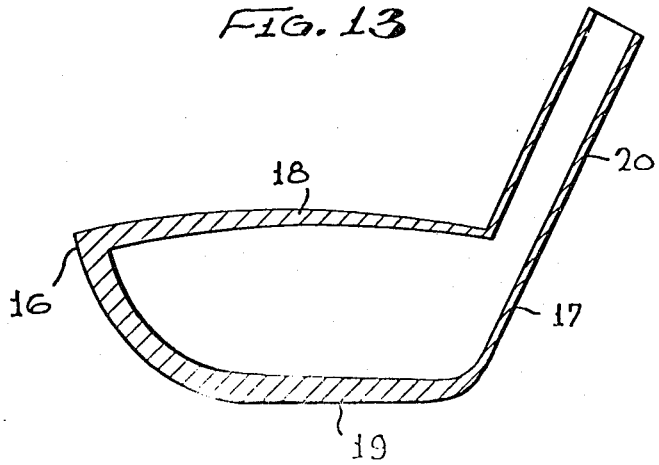
FIG. 14
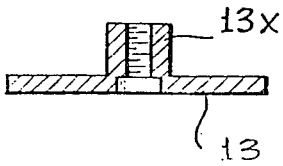

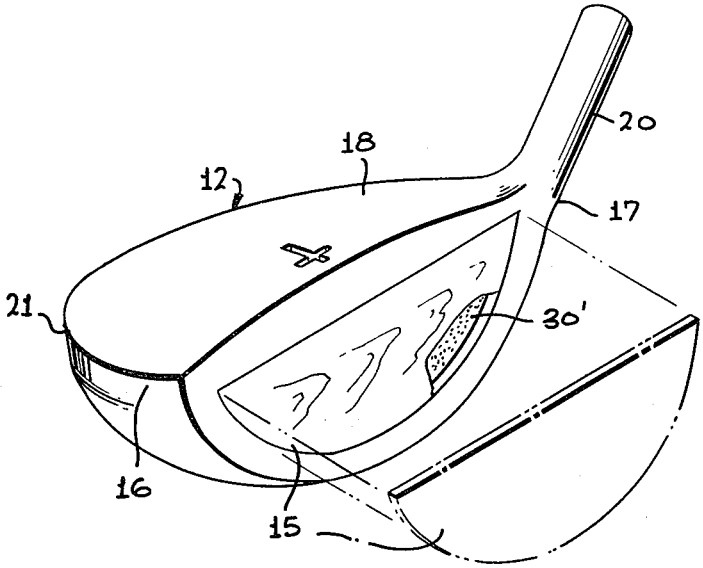
FIG. 9
FIG. 10
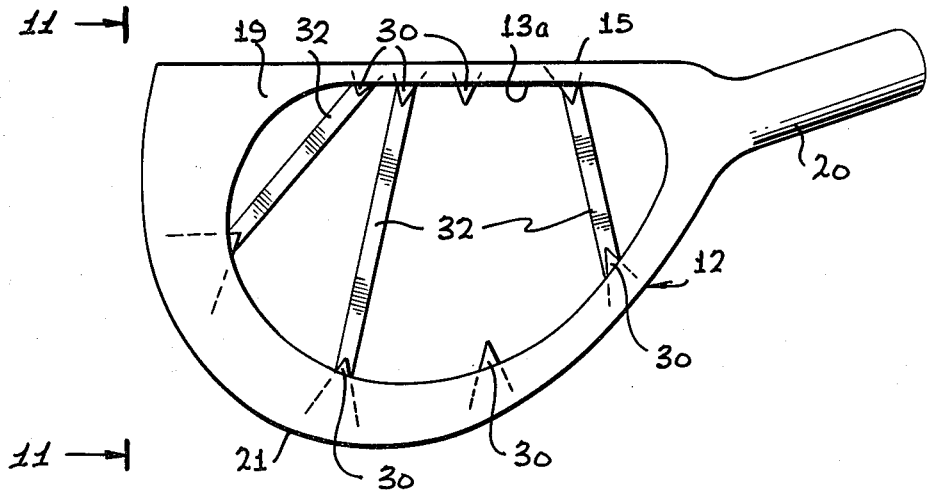
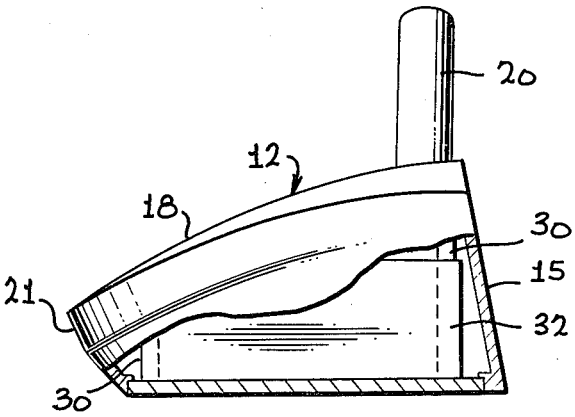
FIG. 11

METAL GOLF DRIVER

CROSS REFERENCE TO RELATED APPLICATIONS

This application is a Continuation-in-part application of application Ser. No. 872,092, filed on Jan. 25, 1978, now U.S. Pat. No. 4,214,754.

BACKGROUND OF THE INVENTION

1. Field of the Invention

The present invention generally relates to golf clubs and more particularly, to golf drivers.

2. Description of the Prior Art

Golf clubs are generally divided into three main classes. These include the putters, the irons, and the drivers. Since the heads of the latter are typically made of wood, they are often referred to as the wood drivers or simply as the woods. They are typically used by most golfers to drive off the tee toward the hole. The head of a wood driver is formed from an appropriately-shaped piece of solid wood, from which a neck extends to accommodate the club's shaft.

Although wood drivers are used by practically all golfers they suffer from a number of very significant disadvantages. The wood tends to chip, become scratched or otherwise disfigured when impacted by sharp objects, which is undesirable. A metallic sole plate is typically attached to the wood head. Despite the advanced means which are used to fasten the sole plate to the wood head, the solid plate tends to become loose and therefore requires repeated servicing. Also, once a wood head is shaped, and each has to be shaped separately, its properties, such as its lie and loft, are fixed and are not capable of being adjusted. Furthermore, the total weight of the wood head, once shaped, remains fixed and unalterable.

These limitations prevent a golfer, who owns a set of wood drivers which are quite expensive, from modifying some of the woods' properties to suit his personal golfing habits and needs. Frequent use of the woods increases their scratching and disfigurement, and necessitates repeated maintenance to resecure the sole plates. Also, due to the fact that wood drivers are shaped of solid wood, there is no way of compensating for torque and deflection which occur when the wood is used to drive a golf ball.

OBJECTS AND SUMMARY OF THE INVENTION

It is a primary object of the present invention to provide a new golf driver which is not made from substantially a solid block of wood.

Another object of the present invention is to provide a golf driver which is not made of a solid block of material and whose lie and loft are adjustable.

Yet another object of the present invention is to provide a golf driver which is practically immune to chipping and with a sole plate which is an integral part of the driver and is a permanent part thereof.

A further object of the present invention is to provide a golf driver with an integral, permanently secured sole plate, and whose loft and lie are adjustable within limits and which is substantially immune to scratching when impacted by sharp objects.

Yet a further object of the present invention is to provide a new method of fabricating an improved golf driver.

These and other objects of the present invention are achieved in one embodiment by forming a metallic golf driver which is hollow inside, so that the entire weight (mass) of the driver consists of the weight of its various sides and the neck extending therefrom. Preferably, the hollow metallic golf driver is formed by casting the metal in the desired hollow shape. The mold, from which the drivers are cast, is shaped so that the various walls or sides of the driver have specifically selected thicknesses to optimize the performance of the driver without excessively increasing the total driver weight. As will be pointed out hereafter, by increasing the mass of the driver from the top side to the sole side and from the heel end to the toe, reduced torque and deflection are achievable. Also, since the driver is of metal, the neck orientation with respect to the driver body can be adjusted to vary, within limits, the driver's lie and loft. Since the driver is of metal it is practically chip free. Also, the driver's sole is an integral part thereof and therefore it cannot separate itself from the rest of the driver body.

The novel features of the invention are set forth with particularity in the appended claims. The invention will best be understood from the following description when read in conjunction with the accompanying drawings.

BRIEF DESCRIPTION OF THE DRAWINGS

FIGS. 1 and 2 are isometric views of one embodiment of the invention.

FIGS. 3 and 4 are views of a golf driver in accordance with the present invention.

FIGS. 7 and 8 are side views with portions of external sides removed to reveal internal structure;

FIG. 9 is an expanded isometric view of another embodiment of the invention;

FIGS. 10 and 11 are respectively a side view of the driver as viewed from the sole side, and a cross-sectional view along lines 11—11;

FIGS. 12–14 are other views useful in explaining the invention; and

FIG. 15 is a sectional view taken along the line 15—15 of FIG. 12.

DESCRIPTION OF THE PREFERRED EMBODIMENTS

Figure 4:
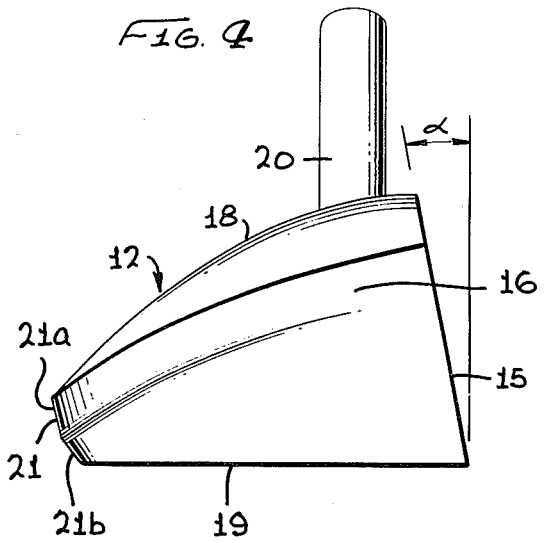

Attention is first directed to FIGS. 1 and 2 which are isometric views of a preferred embodiment of the present invention, comprising a golf driver head, or simply a driver 12. Unlike all prior art golf drivers, golf driver 12 is made of an enclosed metal body, whose features will be described subsequently in more detail in connection with FIGS. 5 and 6, which are cross-sectional views along lines 5—5 and 6—6 in FIG. 1, respectively.

FIG. 1 is also an expanded view of the driver 12. A sole plate 13, which in practice is an integral part of the driver 12 is shown separated from the main driver body. The driver 12 has a face side or simply a face 15, which extends from the driver's toe portion or simply toe 16, to the heel 17 and from the driver's top side 18 to the bottom or sole side 19. The driver 12 also includes a neck 20 which extends therefrom and a back side 21. As is appreciated, the neck is adapted to receive the shaft of the golf driver.

The driver 12, shown in FIG. 1 and the related figures, is an all metal enclosed hollow driver with very significant advantages, as will be detailed hereafter. The particular embodiment was reduced to practice by casting the driver 12 from an appropriate metal, e.g., stainless steel (S.S.) 431 or 17–4. The driver was cast of two parts, as shown in FIG. 1, with practically the entire driver as a first or main part and the sole plate 13 as the second part. The main casting part has an opening 13*a*, which is formed therein to enable the part to be cast as a hollow metal body. After the casting, the sole plate 13 is used to enclose opening 13*a* and is welded thereat as shown by 22 in FIGS. 5 and 6, to become an integral part of the driver.

Preferably, the opening 13*a* is cast with a lip 13*b* (see FIG. 5) to facilitate the alignment of the sole plate 13 in the opening 13*a*. Also, the opening is preferably somewhat larger than the sole plate 13 so that when the latter is welded in the opening to the sole side 19 of the driver the welding material fills the space around the sole plate 13 to insure its permanent and integral mechanical connection with the driver body. Once the sole plate is welded, and the welding joint is polished, the sole plate is indistinguishable from the rest of the driver body. Thus, the driver is a completely enclosed hollow metal body.

The all metal enclosed hollow driver has many significant advantages over the conventional wood driver. When formed of an appropriate metal, e.g., S.S. 431, it is practically chip free, is not easily scratched, and does not rust. Also, since the sole plate 13, once welded, is an integral part of the driver body, there is no danger that the sole plate will loosen itself from the rest of the body, as is the case with a wood driver with an attached metal sole plate. Furthermore, when formed from cast metal, its loft and lie may be adjusted to suit the golfer-owner's desires by adjusting the orientation of the neck 20 with respect to the rest of the body, such as by bending the neck with respect thereto. In FIGS. 4 and 3, which are side views of the driver, the loft and lie are represented by angles $\alpha$ and $\beta$, respectively. Such adjustment cannot be made with a solid wood driver, since the wooden neck cannot be bent without the wood cracking. Furthermore, any expansion or contraction of the all metal stainless steel driver is considerably less than that experienced by a wood driver due to temperature and/or humidity.

In the all-metal driver of the present invention the driver is formed so that its weight is distributed to improve the user's game. In a conventional wood driver a significant amount of weight is at the driver heel in order to strengthen the wooden neck which extends thereat. However, such weight does not improve the driver's performance. In fact, from a performance point of view less weight at the heel is desirable. In the present invention such weight is not necessary since the neck 20 is of metal which extends from a metal body and therefore does not require additional strengthening. Furthermore, in accordance with the present invention the thicknesses of the various sides or walls of the metal driver are chosen to maximize the weights (or mass) in those portions of the driver so that improved performance can be realized. By having more weight at the toe 16 the torque, which is experienced when a golf ball is hit, is reduced. Likewise, by having more weight at the sole side 19 less deflection is experienced.

In accordance with the present invention the driver is shaped so that the thickness of the toe 16 and/or the sole side 19 is greater than that of the top side 18 and/or the face 15. Controlling the thicknesses of the various sides or walls of the driver is easily achieved with the present invention since in accordance with one aspect thereof the metal driver is formed from cast metal. By forming an appropriate mold with appropriate spacings the final thicknesses of the various sides of the cast metal are easily controlled. Once the mold is completed it can be used repeatedly to produce a large number of practically-identical casts, thereby providing identically-shaped drivers. This is clearly not the case with wood drivers in which each driver is formed from a different piece of wood of different grain structure and is separately shaped. Since many cast metal drivers may be formed with a single mold, the average cost per metal driver is expected to be less than a separately machined and shaped wood driver.

Another advantage of the cast metal driver is the ability to incorporate any desired indicia thereon, generally designated by 25 in FIG. 2. This may be achieved by incorporating the indicia in the mold so that each cast driver includes such indicia. In present day wood drivers any indicia has to be engraved and/or printed on the driver as an additional manufacturing step.

Figure 5:
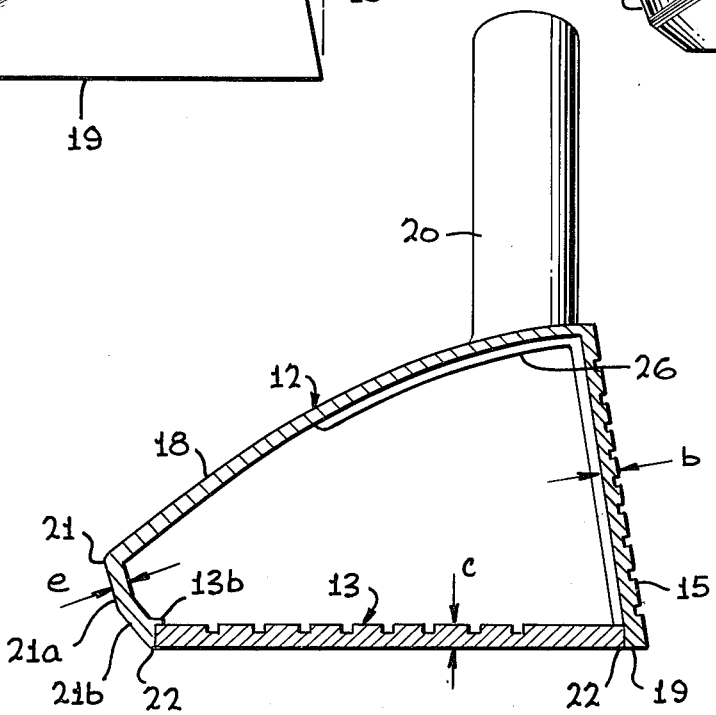
FIGS. 5 and 6 are cross-sectional views along lines 5—5 and 6—6 in FIG. 1.
Figure 6:
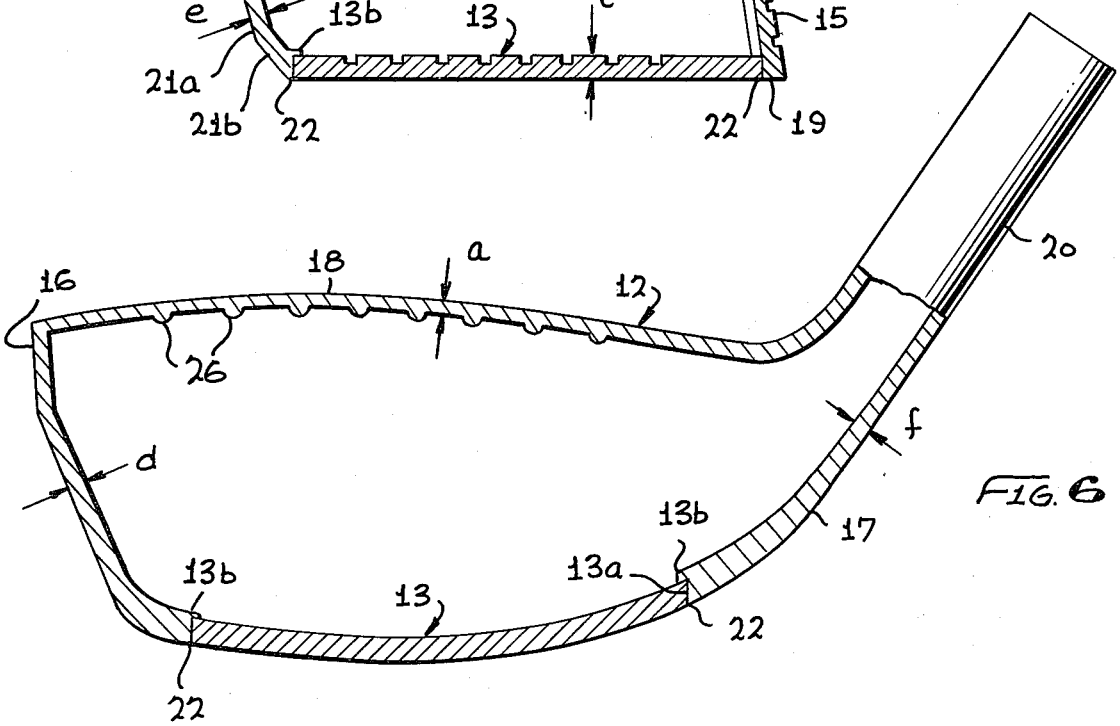

From the foregoing it should thus be appreciated that the castable hollow metal driver of the present invention, particularly with non-uniform wall thickness provides many significant advantages over prior art drivers. In one particular embodiment, actually reduced to practice, cast from S.S. 431, the metal driver has the following thicknesses which are presented as an example only, rather than to limit the invention thereto. The thickness of the top side 18 represented by "a" in FIGS. 5 and 6 is on the order of 0.060 in., while the thickness of face 15 as shown by "b" in FIG. 5 is on the order of 0.080. The thickest portions of the driver are the sole side 19, represented by "c" which is on the order of 0.125 in., while the toe portion 16, as represented by "d", increases from about 0.060 near the top side 18 to about 0.100–0.125 near the sole side 19. As to the back side 21 (see FIG. 5) its thickness, as represented by "e", increases from about 0.060–0.080 in. at the edge near the top side 18 to about 0.100–0.125 near the sole side 19, particularly toward the toe 16. However, near the heel side 17 the back side thins out to about 0.060–0.080 in order to reduce the driver's weight at the heel. Also, the heel thickness as shown by f in FIG. 6 decreases from the sole side where its thickness is on the order of 0.100 to 0.060–0.080 in. near the neck 20. In the particular embodiment the neck thickness is about 0.045 in. with an ID (inside diameter) of 0.355 and is about 1 in. in length. In casting the driver, the inside area where the neck extends from the rest of the body, may be thickened to about 0.100–0.125 for strengthening purposes.

It has been discovered that in addition to the above-described advantages the metal driver of the present invention possesses several additional advantages over the typical wood driver. The metal driver's total weight is greater than that of wood driver of the same swing weight by several grams, on the order of 10 grams, which is highly desirable. For example, a metal driver was cast from S.S. 431 with thicknesses in the ranges herebefore described with a swing weight of D0 weighed about 202–203 gr. A comparable wood driver with a swing weight of D0 weights about 191–194 gr. The particular metal driver of the invention had a volume of 6.419 cubic inches, while the volume of the metal only, excluding the hollow space was 1.572 in.$^3$.

In the particular embodiment, which was reduced to practice, the back side does not curve continuously from the top to the sole sides. Rather it has an upper portion 21*a* (see FIGS. 2 and 5) which is nearly perpendicular to the top side 18 and a lower portion 21*b* which curves toward the sole side. It has been found that such a shape of the back side may improve the driver's expected performance.

Figure 7:
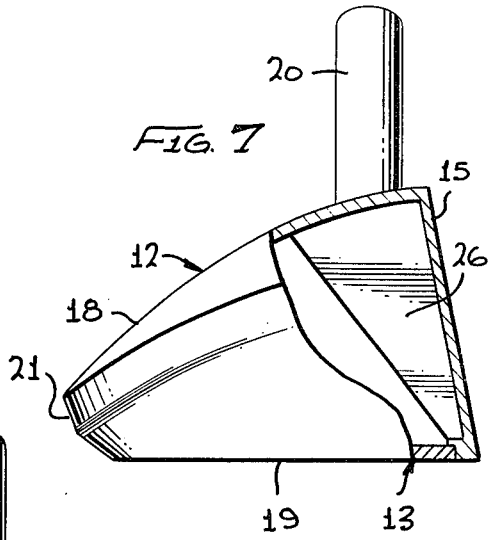

As previously pointed out, the driver's weight is concentrated in the toe to reduce torque and in the sole side to reduce deflection, while the face and top sides are the thinnest walls. In some cases it may be desirable to cast the driver so that spaced-apart rib-like members 26 (see FIGS. 5 and 6) extend internally and bridge the thin face with the top side. In FIG. 5 these members or bridges are shown as L-shaped. If desired, the bridges may be diagonally shaped as shown in FIG. 7. Furthermore, they may be rectangularly shaped, as shown in FIG. 8, extending from the top side 18 along the inner side of the face 15 toward the location of the sole plate 13. In such an arrangement the sole plate 13 may be attached to the rectangularly shaped bridges 26 by screws 27, rather than by welding it to the driver body. Since such screws are threaded into metal, the likelihood of the sole plate becoming loose is small. Also it should be appreciated that the sole plate 13, rather than being attached to the rectangularly shaped bridged by screws 27, may be welded thereto.

In the foregoing description (as shown in FIG. 1) the driver is cast of two parts, the main part being practically the entire driver body and the other part the sole plate. In all probability, all embodiments of the cast driver of the invention will be cast of two parts, which are then integrally connected, such as by welding, to form an integral driver body. Clearly more than two parts may be cast. However, this would increase the cost since more parts will have to be welded together.

The invention is not intended to be limited to a driver in which ar one of the cast parts is the sole plate. If desired, one cast part may consist of top side 18, the face side 15 and the neck 20, with the other part consisting of the back side, the toe 16, the sole side 19 and the heel 17. However, in such an embodiment the welding seal would be considerably longer than in the case of the separate sole plate.

In another embodiment, as shown in FIG. 9, one of the two cast parts may be the face side 15 which can then be welded in place. Since most golfers are used to wood drivers which produce a particular sound when hitting the ball, typical of wood hitting a solid object, if desired, the face 15 may be formed of a selected wood or hard plastic which can then be screwed or otherwise attached to the hollow metal driver. With such a driver, the sound, upon impacting a ball, would be closer to that produced by the impact of a ball with a wood driver. Also, to reduce any unaccustomed or objectionable sounds, due to the hollowness of the metal driver, if desired, it may be filled with a hardening liquid, represented in FIG. 9 by 30'.

Except when filled with a hardening liquid, such as liquid 30, the driver is hollow. Therefore, part of the unoccupied space may be used to locate therein inserts of selected shapes and weights and thereby vary the driver's total weight, as well as its swing weight. This aspect may best be explained in connection with FIG. 10, which is a view of the driver 12 from the sole side 19, without the sole plate 13. The main driver part can be cast to have protrusions 30 extending inwardly from the face 15 and the backside 21. In FIG. 10 they are shown as triangular for example only. Before welding the sole plate 13, inserts 32 of desired weights and shapes may be attached to opposite protrusions 30. The inserts may be of any desired matter, e.g., wood, plastic, metal, etc. Wood or plastic inserts may be glued to the protrusions, such as with epoxy, while metal inserts may be welded thereto.

After the one or more inserts of different shapes and weights are secured at the desired different locations within the driver, the sole plate 13 is then welded to form the integral complete driver body. When such inserts are incorporated they may be in addition to or in place of the rib-like members 26, herebefore described. It should be pointed out that not all protrusions need be used. The number of inserts, their shapes and locations, are chosen, depending on the desired swing weight of the driver. It should also be pointed out that by placing inserts close to the toe, the effective total weight is increased and, therefore, less torque will be produced.

In the foregoing a driver is described in which the thickness or mass of the top side 18, front face 15 and the sole side 19 are assumed to be of uniform thickness, while the thicknesses of the toe 16 and back side 21 increase from the top side to the sole side. In accordance with another preferred embodiment of the invention the thicknesses of the front face 15, the top side 18 and the sole side 19 vary in order to increase the driver's mass toward the sole side and the toe, as well as toward the front face.

Attention is now directed to FIGS. 12 and 13 which are similar to FIGS. 5 and 6, respectively. As shown in FIG. 12 the thickness of front face 15 increases from the top side 18 toward the sole side 19. Also, the front face 15 increases in thickness from the heel end toward the toe (FIG. 15). As regards the top side 18 and the sole side 19 they increase in thickness from the back side 21 toward the front face 15. As seen from FIG. 13 the thicknesses of the top side 18 and the sole side 19 also vary from the heel end 17 to the toe 16. The thicknesses of the sole side and the top side increase from heel to toe.

From the foregoing it should thus be appreciated that in the novel driver various sides of the driver vary in thickness so that the driver's mass increases from the top side to the sole side, from the heel end toward the toe and from the back toward the front. With such a driver, torque and deflection are greatly reduced. Such reduction results in increased effective area of the front face over which a golf ball can be struck to travel in a desired direction with increased distance.

It should be pointed out that the change in mass distribution of any side can be achieved by increasing the side thickness in the desired direction e.g. from heel to toe. Likewise, the side may be cast of uniform thickness with spaced apart ridges or ribs, in order to produce the same effect as if the side were cast with varying thickness. As claimed herein both arrangements are intended to be included when referring to the mass distribution of a side as increasing from one end or side to another. In practice when made of stainless steel the thickness of any side is in the range of 0.025 in. to 0.200 in. It should also be pointed out that the front face 15 may be of other than metal e.g. wood or plastic as shown in FIG. 9.

In practice the hollow driver is filled with hardening material, e.g. polyurethane, such as represented by 30' in FIG. 9. In one embodiment of the invention the sole plate 13 is cast with a projection 13*x*, as shown in FIG. 14. The projection is near the sole center. After casting, it is drilled and tapped to receive a plugging screw (not shown). In practice, the sole 13 is welded to the sole side and thereafter the entire driver is polished. Then the neck 20 is plugged up and a shaft is secured in the neck by epoxy or the like. Thereafter, the cavity or opening of the driver is filled with hardening matter through the hole in projection 13*x*. A plugging screw is then used to close the driver. The screw fulfills another function. Quite often after the driver is polished, its weight may vary somewhat from the desired one. This is compensated for by inserting a plugging screw of different length and therefore of different weight. It has been found that by using screws of different lengths the swing weight of the driver can be changed to that desired by the user.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A golf driver comprising:

an enclosed body of preselected metal, shaped in the form of a golf driver head having a front face side 15, a bottom sole-defining side 19, a back side 21, a heel 17 and an opposite toe 16, a top side 18 and a hollow neck 20 extending from said body at said heel 17 at a preselected angle, the mass of said body being distributed to increase from the top side 18 toward the bottom sole-defining side 19 and from the heel 17 toward the toe 16 by progressively *and continuously* varying the thicknesses of selected ones of said sides from one end to the other, with said to side 18 progressively *and continuously* increasing in thickness from said back side 21 toward said front face side 15.

2. A golf driver as recited in claim 1 wherein the mass distribution of the front face side 15 increases from the top side 18 to the sole-defining side 19 and from the heel 17 to the toe 16.

3. A golf driver as recited in claim 2 wherein the mass distribution of the toe 16 increases from the top side 18 toward the sole-defining side 19.

4. A golf driver as recited in claim 2 wherein the mass distribution of the back side 21 increases from the heel 17 to the toe 16 and from the top side 18 to the sole-defining side 19.

5. A golf driver as recited in claim 2 wherein the mass distribution of the top side 18 increases from the heel 17 towards the toe 16 and from the back side 21 toward the front face side 15.

6. A golf driver as recited in claim 1 wherein the mass distribution of the sole-defining side 19 increases from the heel 17 to the toe 16 and from the back side 21 to the front face side 15.

7. A golf driver as recited in claim 6 wherein the mass distribution of the front face side 15 increases from the top side 18 to the sole-defining side 19 and from the heel 17 to the toe 16.

8. A golf driver as recited in claim 7 wherein the mass distribution of the toe 16 increases from the top side 18 toward the sole-defining side 19.

9. A golf driver as recited in claim 7 wherein the mass distribution of the back side 21 increases from the heel 17 to the toe 16 and from the top side 18 to the sole-defining side 19.

10. A golf driver as recited in claim 7 wherein the mass distribution of the top side 18 increases from the heel 17 toward the toe 16 and from the back side 21 toward the front face side 15.

11. A golf driver as recited in claim 1 wherein the metal is stainless steel and the thickness of any of said sides being in the range of 0.025 inch to 0.200 inch.

12. A golf driver as recited in claim 1 with said top side 18, said bottom side 19 and said front face side 15 progressively increasing in thickness from said heel 17 to said toe 16.

13. A golf driver comprising an enclosed metal body shaped in the form of a golf driver head and having a front face side 15, a bottom sole-defining side 19, a back side 21, a heel 17 and an opposite toe 16, a top side 18 and a hollow neck 20 extending upward from said body at said heel 17, with the mass of said body distributed to increase from said back side 21 toward said front face side 15 by progressively and continuously increasing the thickness of said top side 18 from said back side 21 to said front face side 15.

14. A golf driver as defined in claim 13 with the mass of said body distribution to increase from said top side 18 toward said bottom sole-defining side 19 and from said heel 17 toward said toe 16 by progressively and continuously increasing the thickness of said top side 18, said bottom side 19 and said front face side 15 from said heel 17 to said toe 16.

* * * * *